US006736495B2

(12) United States Patent
Wu et al.

(10) Patent No.: US 6,736,495 B2
(45) **Date of Patent: *May 18, 2004**

(54) REPLENISHMENT SYSTEM WITH AN OPEN-VALVE PRINTHEAD FILL PORT CONTINUOUSLY CONNECTED TO A LIQUID SUPPLY

(75) Inventors: Paul S. Wu, Encinitas, CA (US); Erich E. Coiner, Poway, CA (US); Mark E. Young, Santa Rosa, CA (US); Max Stephen Gunther, La Jolla, CA (US); David S. Hunt, San Diego, CA (US)

(73) Assignee: Hewlett-Packard Development Company, LP., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/386,806

(22) Filed: Mar. 10, 2003

(65) Prior Publication Data

US 2003/0142176 A1 Jul. 31, 2003

Related U.S. Application Data

(63) Continuation of application No. 09/670,608, filed on Sep. 26, 2000, now abandoned, which is a continuation-in-part of application No. 09/045,150, filed on Mar. 19, 1998, now abandoned, which is a continuation-in-part of application No. 08/615,903, filed on Mar. 14, 1996, now Pat. No. 5,777,648, which is a continuation-in-part of application No. 08/322,848, filed on Oct. 13, 1994, now Pat. No. 5,621,445, which is a continuation-in-part of application No. 08/171,321, filed on Dec. 21, 1993, now abandoned, which is a continuation of application No. 07/750,360, filed on Aug. 27, 1991, now Pat. No. 5,280,300, said application No. 08/615,903, filed on Mar. 14, 1996, now Pat. No. 5,777,648, is a continuation-in-part of application No. 08/503,756, filed on Jul. 18, 1995, now abandoned, which is a continuation of application No. 07/995,108, filed on Dec. 22, 1992, now Pat. No. 5,434,603, which is a continuation-in-part of application No. 07/717,735, filed on Jun. 16, 1991, now Pat. No. 5,359,353, application No. 09/045,150, filed on Mar. 19, 1998, now abandoned, which is a continuation-in-part of application No. 08/454,975, filed on May 31, 1995, now Pat. No. 5,745,137, which is a continuation-in-part of application No. 07/995,851, filed on Dec. 23, 1992, now Pat. No. 5,757,406, which is a continuation-in-part of application No. 07/929,615, filed on Aug. 12, 1992, now abandoned, application No. 09/045,150, filed on Mar. 19, 1998, now abandoned, which is a continuation-in-part of application No. 08/726,587, filed on Oct. 7, 1996, now Pat. No. 5,874,976.

(51) Int. Cl.[7] ..... B41J 2/175
(52) U.S. Cl. ..... 347/85
(58) Field of Search ..... 347/84–87

(56) References Cited

U.S. PATENT DOCUMENTS 4,831,389 A 5/1989 Chan
5,280,300 A 1/1994 Fong et al.

(List continued on next page.)

*Primary Examiner*—Judy Nguyen

(57) ABSTRACT

Techniques for liquid replenishment in a printer/plotter. An ink delivery system (IDS) is employed wherein the on-carriage spring reservoir of the print cartridge is manually and securely connected to the off-carriage reservoir. A pen cartridge that uses an internal spring to provide vacuum pressure is connected from an inlet port through a unitary coupler to an ink reservoir located off the scanning carriage axis. The coupler serves to align as well as to secure two mating valves to securely hold them together in an open latched position which is not intended to be modified or disconnected until the entire ink supply has been depleted. A replaceable ink supply module for providing replenishment of an inkjet printhead includes a collapsible bag, an enclosure box, a connective tube, and an on/off valve. These four components are incorporated into a composite sealed system which remains intact during shipment, storage, installation and operation. The collapsible bag is placed inside the protective enclosure box and has an end-connect outlet permanently attached to one end of the connective tube. The other end of the connective tube carries a permanently attached on/off valve designed for engagement with an inlet valve of an inkjet printhead.

16 Claims, 12 Drawing Sheets

U.S. PATENT DOCUMENTS 5,367,328 A 11/1994 Erickson
5,450,112 A 9/1995 Scheffelin
5,686,947 A 11/1997 Murray et al.
5,691,754 A 11/1997 Ta
5,719,610 A 2/1998 Scheffelin
5,736,992 A 4/1998 Pawlowski, Jr.
5,745,137 A 4/1998 Scheffelin et al.
5,751,319 A 5/1998 Robertson et al.
5,813,339 A 9/1998 Schmitt et al.
5,852,458 A 12/1998 Scheffelin et al.
5,852,459 A 12/1998 Pawlowski, Jr. et al.
5,874,976 A 2/1999 Katon et al.
5,929,883 A 7/1999 Gunther et al.
6,120,132 A 9/2000 Coiner et al.

REPLENISHMENT SYSTEM WITH AN OPEN-VALVE PRINTHEAD FILL PORT CONTINUOUSLY CONNECTED TO A LIQUID SUPPLY

CROSS REFERENCE TO RELATED APPLICATION(S)

This application is a continuation of U.S. Ser. No. 09/670,608, filed Sep. 26, 2000 now abandoned, in turn a continuation-in-part of U.S. Ser. No. 09/045,150, filed Mar. 19, 1998, in turn a continuation-in-part of U.S. Ser. No. 08/615,903 filed Mar. 14, 1996 by Scheffelin et al. entitled "Inkjet Print Cartridge Having Two Ink Inlet Ports For Initial Filling And Recharging" now U.S. Pat. No. 5,777,648 which is a continuation-in-part of Ser. No. 08/322,848 filed Oct. 13, 1994, now U.S. Pat. No. 5,621,445 which is a continuation-in-part of Ser. No. 08/171,321 filed Dec. 21, 1993, now abandoned, which is a continuation of Ser. No. 07/750,360 filed Aug. 27, 1991, now U.S. Pat. No. 5,280,300; said Ser. No. 08/615,903 is also a continuation-in-part of Ser. No. 08/503,756 filed Jul. 18, 1995, now abandoned, which is a continuation of Ser. No. 07/995,108 filed Dec. 22, 1992, now U.S. Pat. No. 5,434,603 which is a continuation-in-part of Ser. No. 07/717,735 filed Jun. 16, 1991 now U.S. Pat. No. 5,359,353. Application Ser. No. 09/045,150 is also a continuation-in-part of U.S. Ser. No. 08/454,975 filed May 31, 1995 by Scheffelin et al. entitled "Continuous Refill Of Spring Bag Reservoir In An Ink-Jet Swath Printer/Plotter" now U.S. Pat. No. 5,745,137 which is a continuation-in-part of Ser. No. 07/995,851 filed Dec. 23, 1992, now U.S. Pat. No. 5,757,406 which is a continuation-in-part of Ser. No. 07/929,615 filed Aug. 12, 1992, which subsequently issued as U.S. Pat. No. 5,767,882 through file wrapper continuing application Ser. No. 08/240,297, which are incorporated by reference herein. Application Ser. No. 09/045,150 is also a continuation-in-part of U.S. Ser. No. 08/726,587 filed Oct. 7, 1996 by Max S. Gunther, Mark E. Young, David S. Hunt, et al. entitled "Inkjet Cartridge Fill Port Adapter", now issued as U.S. Pat. No. 5,874,976. All three parent cases are commonly assigned to the assignee of the present application.

CROSS-REFERENCE TO RELATED APPLICATIONS

Other more recent co-pending commonly assigned related applications are Ser. No. 09/045,151, now U.S. Pat. No. 6,059,401, "Alignment Coupling Device For Manually Connecting An Ink Supply To An Inkjet Print Cartridge" filed Mar. 19, 1998 by Paul S. Wu et al., and Ser. No. 09/045,148, now U.S. Pat. No. 6,120,132, "Assembly Technique Using Modular Ink Delivery Components For Installation In An Inkjet Printer" filed Mar. 19, 1998 by Erich E. Coiner et al., both of which are incorporated by reference herein.

A previously filed co-pending commonly assigned application related to this application is Ser. No. 08/454,975 filed May 31, 1995 by Joseph E. Scheffelin et al. (the "'975 application") entitled CONTINUOUS REFILL OF SPRING BAG RESERVOIR IN AN INK-JET SWATH PRINTER/PLOTTER, which is incorporated herein by reference.

Other more recent co-pending commonly assigned related applications are Ser. No. 08/726,587, INKJET CARTRIDGE FILL PORT ADAPTOR, filed Oct. 7, 1996, by Max S. Gunther et al.; Ser. No. 08/810,485, INKJET PRINTING WITH REPLACEABLE SET OF INK-RELATED COMPONENTS etc., filed Mar. 3, 1997, by Rick Becker, et al.; Ser. No. 08/805,859, REPLACEABLE INK SUPPLY MODULE (BAG/BOX/TUBE/VALVE) etc., filed Mar. 3, 1997, by Elizabeth Zapata, et al.; Ser. No. 08/805,860, SPACE EFFICIENT ENCLOSURE SHAPE FOR NESTING TOGETHER A PLURALITY OF REPLACEABLE INK SUPPLY BAGS, filed Mar. 3, 1997, by Erich Coiner, et al.; Ser. No. 08/810,840, PRINTING SYSTEM WITH SINGLE ON/OFF CONTROL VALVE etc., filed Mar. 3, 1997 by Max S. Gunther, et al.; Ser. No. 08/805,861, INTERCHANGEABLE FLUID INTERCONNECT ATTACHMENT AND INTERFACE, filed Mar. 4, 1998 by Max S. Gunther; all of which are incorporated herein by reference.

TECHNICAL FIELD OF THE INVENTION

This invention relates to inkjet printers and more particularly to an inkjet print cartridge which can be recharged with ink.

BACKGROUND OF THE INVENTION

A popular type of inkjet printer contains a scanning carriage for supporting one or more disposable print cartridges. Each disposable print cartridge contains a supply of ink in an ink reservoir, a printhead, and ink channels which lead from the ink reservoir to ink ejection chambers formed on the printhead. An ink ejection element, such as a heater resistor or a piezoelectric element, is located within each ink ejection chamber. The ink ejection elements are selectively fired, causing a droplet of ink to be ejected through a nozzle overlying each activated ink ejection chamber so as to print a pattern of dots on the medium. When such printing takes place at 300 dots per inch (dpi) or greater, the individual dots are indistinguishable from one another and high quality characters and images are printed.

Once the initial supply of ink in the ink reservoir is depleted, the print cartridge is disposed of and a new print cartridge is inserted in its place. The printhead, however, has a usable life which outlasts the ink supply. Methods have been proposed to refill these single-use-only print cartridges, but such refilling techniques require penetration into the print cartridge body in a manner not intended by the manufacturer and typically require the user to manually inject the ink into the print cartridge. Additionally, the quality of the refill ink is usually lower than the quality of the original ink. As a result, such refilling frequently results in ink drooling from the nozzles, a messy transfer of ink from the refill kit to the print cartridge reservoir, air pockets forming in the ink channels, poor quality printing resulting from the ink being incompatible with the high speed printing system, and an overall reduction in quality of the printed image.

What is needed is an improved structure and method for recharging the ink supply in an inkjet print cartridge which is not subject to any of the above-mentioned drawbacks of the existing systems.

SUMMARY OF THE INVENTION

A new ink delivery system (IDS) for printer/plotters has been developed wherein the on-carriage spring reservoir of the print cartridge is manually and securely connected to the off-carriage reservoir.

This invention optimizes the performance of this new off-carriage continuous ink delivery system. In this type of IDS, a pen cartridge that uses an internal spring to provide vacuum pressure is connected from an inlet port through a unitary coupler to an ink reservoir located off the scanning carriage axis. The coupler serves to align as well as to secure two mating valves to securely hold them together in an open latched position which is not intended to be modified or disconnected until the entire ink supply has been depleted.

A replaceable ink supply module for providing replenishment of an inkjet printhead includes a collapsible bag, an enclosure box, a connective tube, and an on/off valve. These four components are incorporated into a composite sealed system which remains intact during shipment, storage, installation and operation. The collapsible bag is placed inside of the protective enclosure box and has an end-connect outlet permanently attached to one end of the connective tube. The other end of the connective tube carries a permanently attached on/off valve designed for engagement with an inlet valve of an inkjet printhead.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENTS

Figure 1:
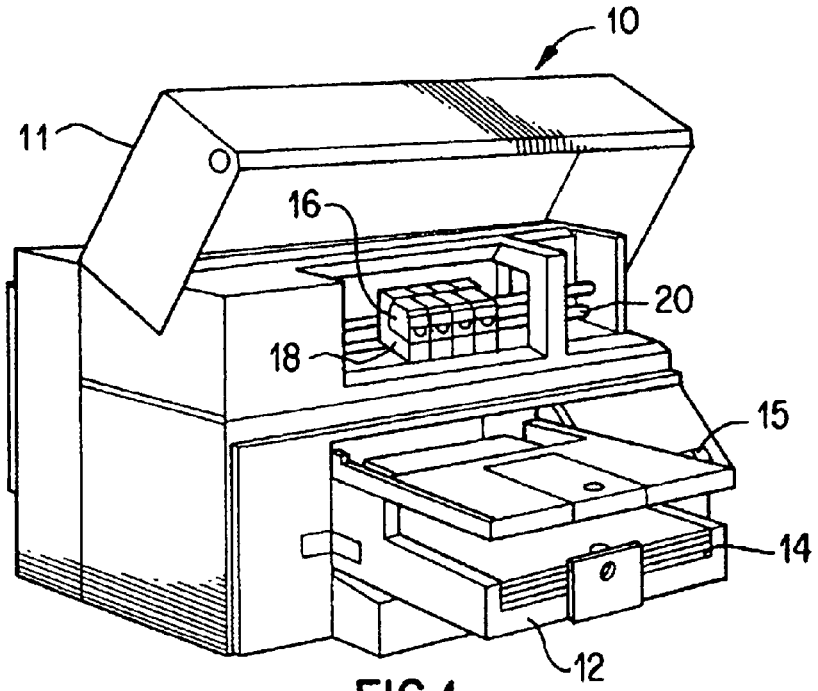
FIG. 1 is a perspective view of an inkjet printer incorporating an embodiment of an inkjet print cartridge.

FIG. 1 illustrates an inkjet printer 10 incorporating the preferred embodiment rechargeable print cartridge. Inkjet printer 10 itself may be conventional. A cover 11 protects the printing mechanism from dust and other foreign objects. A paper input tray 12 supports a stack of paper 14 for printing thereon. The paper, after printing, is then deposited in an output tray 15.

In the embodiment shown in FIG. 1, four print cartridges 16 are mounted in a scanning carriage 18. Print cartridges 16 contain black cyan, magenta, and yellow ink respectively. Selective activation of the ink firing elements in each of the four print cartridges 16 can produce a high resolution image in a wide variety of colors. In one embodiment, the black inkjet print cartridge 16 prints at 600 dots per inch (dpi), and the color print cartridges 16 print at 300 dpi.

The scanning carriage 18 is slideably mounted on a rod 20. and carriage 18 is mechanically scanned across the paper, using a well-known belt/wire and pulley system, while print cartridges 16 eject droplets of ink to form printed characters or other images. Since the mechanisms and electronics within printer 10 may be conventional, printer 10 will not be further described in detail.

Figure 2:
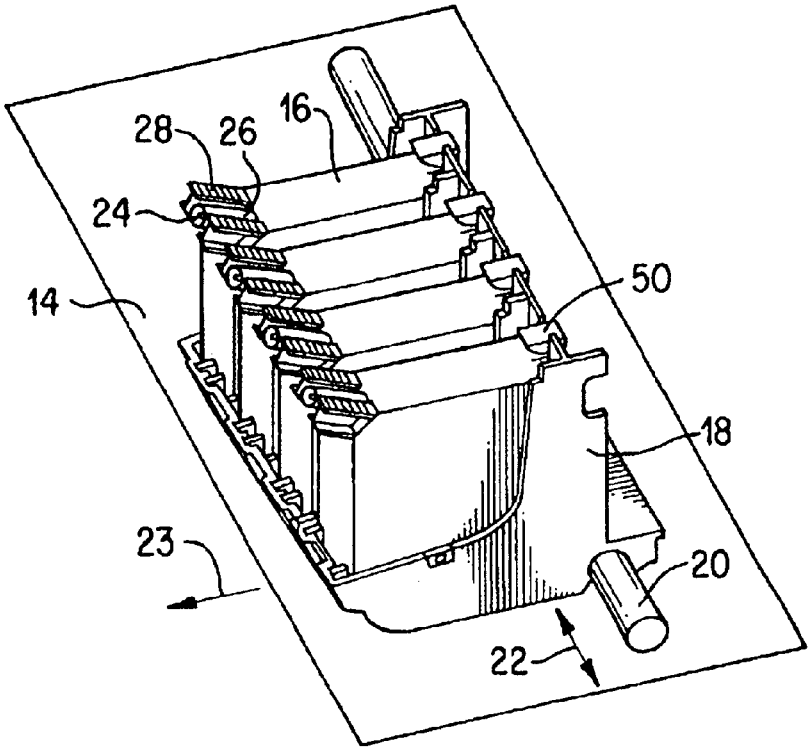
FIG. 2 is a perspective view of a preferred embodiment of a print cartridge being supported by a scanning carriage in the printer of FIG. 1.

FIG. 2 is a more detailed view of the scanning carriage 18 housing print cartridges 16. Carriage 18 moves in the direction indicated by arrow 22, and a sheet of paper 14 moves in the direction of arrow 23 perpendicular to the direction of movement of carriage 18.

Each print cartridge 16 is removable and engages with fixed electrodes on carriage 18 to provide the electrical signals to the printheads within each of print cartridges 16. Each of print cartridges 16 contains a valve 24 which may be opened and closed. In an open state, ink from an external ink supply may flow through valve 24 and into the ink reservoir within print cartridge 16. Valve 24 is surrounded by a cylindrical plastic sleeve 26, which generally forms part of a handle 23 for allowing the user to easily grasp print cartridge 16 for insertion into and removal from carriage 18.

Figure 3:
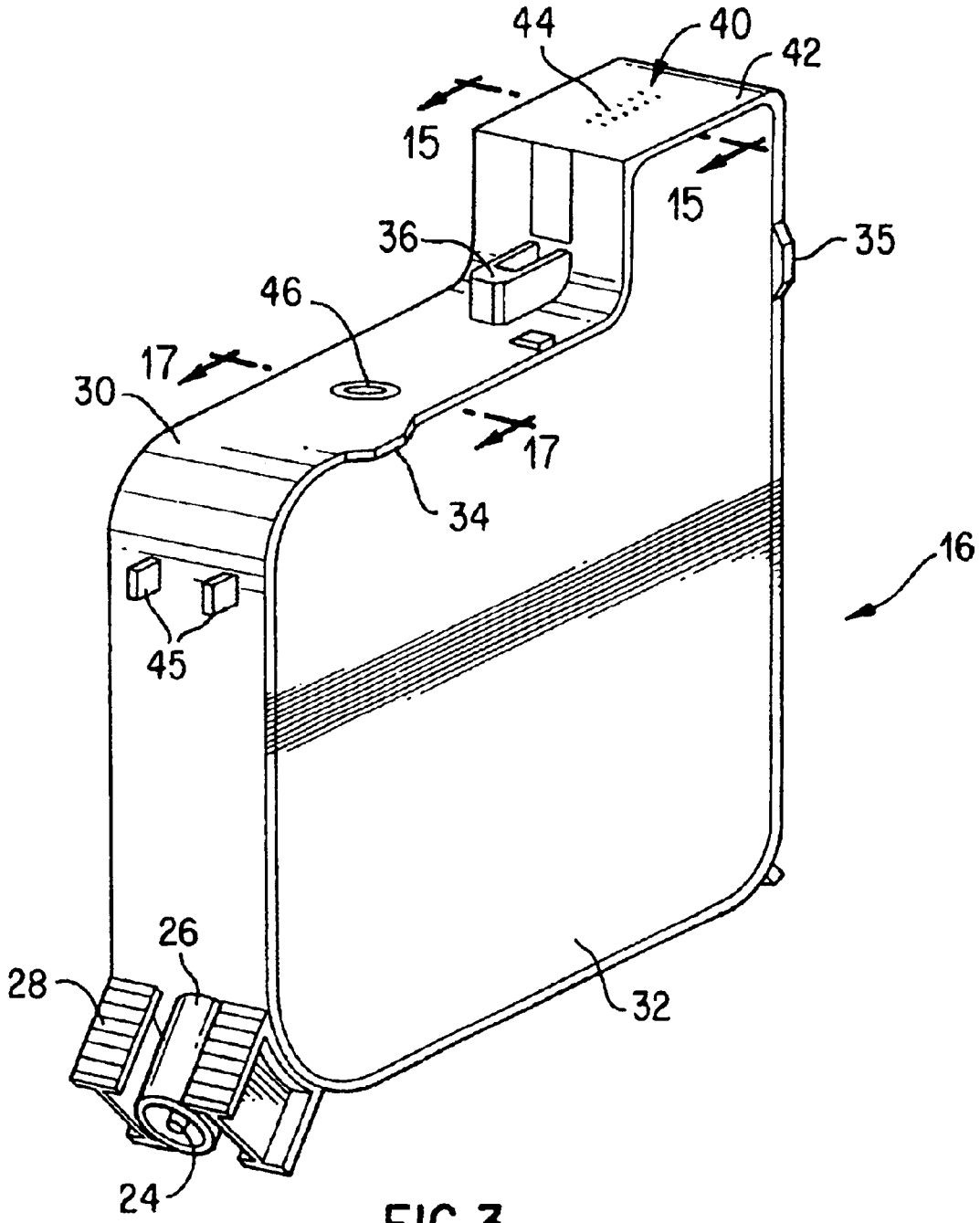
FIG. 3 is a perspective view of a preferred embodiment of a print cartridge incorporating a refill valve.

FIG. 3 shows one perspective view of the preferred embodiment print cartridge 16. Elements labeled with the same numerals in other figures are identical. The outer frame 30 of print cartridge 16 is formed of molded engineering plastic such as the material marketed under the trademark "NORYL" by General Electric Company. Side covers 32 may be formed of metal or plastic. Datums 34, 35, and 36 affect the position of the print cartridge 16 when installed in carriage 18.

In the preferred embodiment, nozzle member 40 consists of a strip of flexible tape 42 having nozzles 44 formed in the tape 42 using laser ablation.

Plastic tabs 45 are used to prevent a particular print cartridge 16 from being inserted into the wrong slot in carriage 18. Tabs 45 are different for the black, cyan, magenta, and yellow print cartridges.

A fill hole 46 is provided for initially filling the ink reservoir in print cartridge 16 by the manufacturer. This hole 46 is later sealed with a steel ball, which is intended to be permanent. Such filling will be described later.

Figure 4:
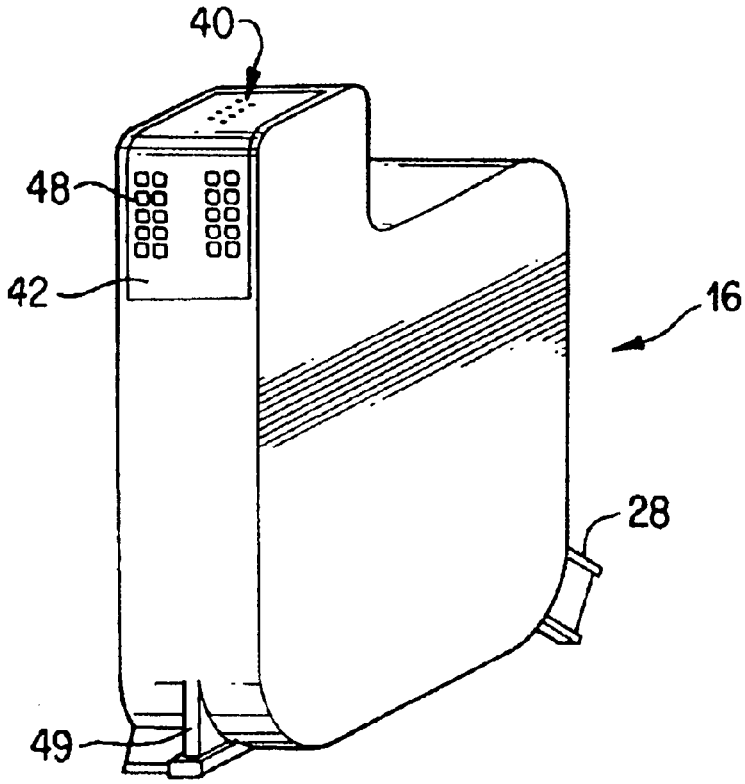
FIG. 4 is a different perspective view of the print cartridge of FIG. 3.

FIG. 4 is another perspective view of print cartridge 16 showing electrical contact pads 48 formed on the flexible tape 42 and connected via traces, formed on the underside of tape 42, to electrodes on the printhead substrate affixed to the underside of tape 42.

A tab 49 engages a spring-loaded lever 50 (FIG. 2) on carriage 18 for locking print cartridges 16 in place in carriage 18.

Figure 5:
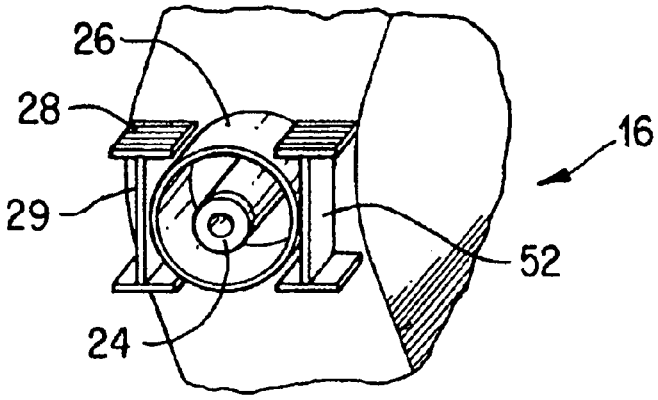
FIG. 5 is a close-up view of one type of refill valve on the print cartridge of FIG. 3.

FIG. 5 is a close-up of the print cartridge valve 24 surrounded by the cylindrical sleeve 26, forming part of handle 28. Support flanges 52 provide added support for handle 28.

A printing system is described in the commonly assigned patent application entitled CONTINUOUS REFILL OF SPRING BAG RESERVOIR IN AN INK-JET SWATH PRINTER/PLOTTER which employs off-carriage ink reservoirs connected to on-carriage print cartridges through flexible tubing. The off-carriage reservoirs continuously replenish the supply of ink in the internal reservoirs of the on-carriage print cartridges, and maintain the back pressure in a range which results in high print quality.

Figure 6:
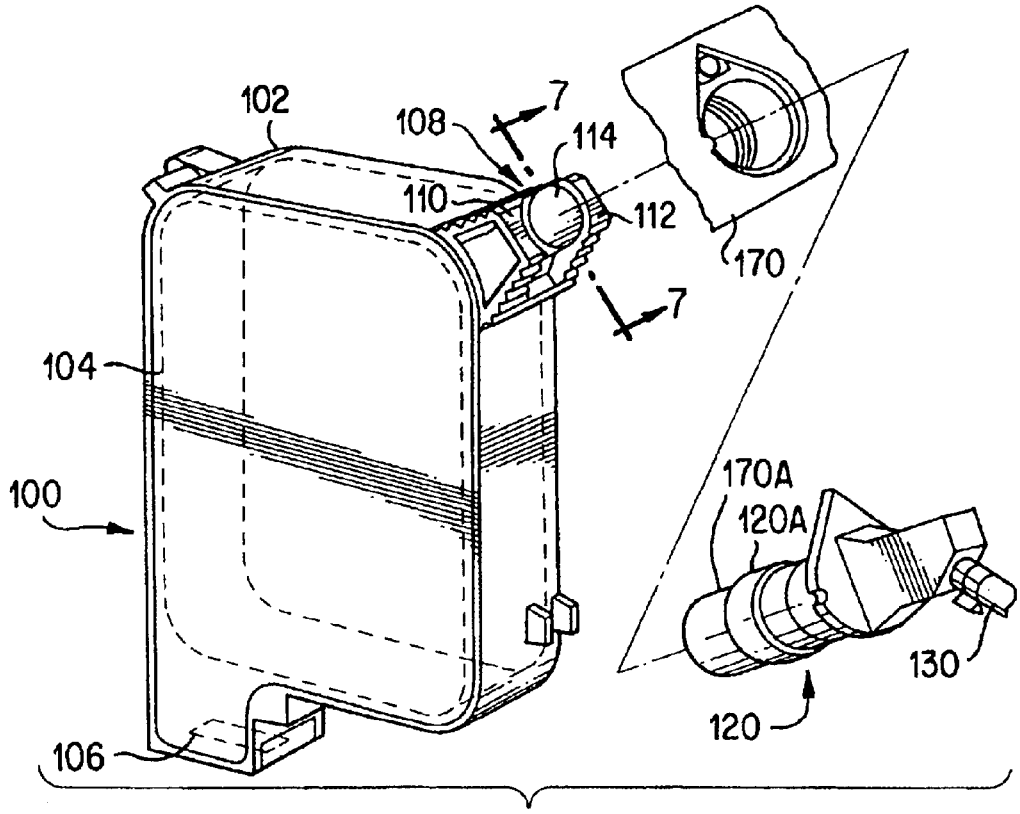
FIG. 6 is an isometric view of an ink-jet print cartridge usable in the system of FIG. 1, with a refill platform housing portion, a needle valve, and supply tube in exploded view.
Figure 7:
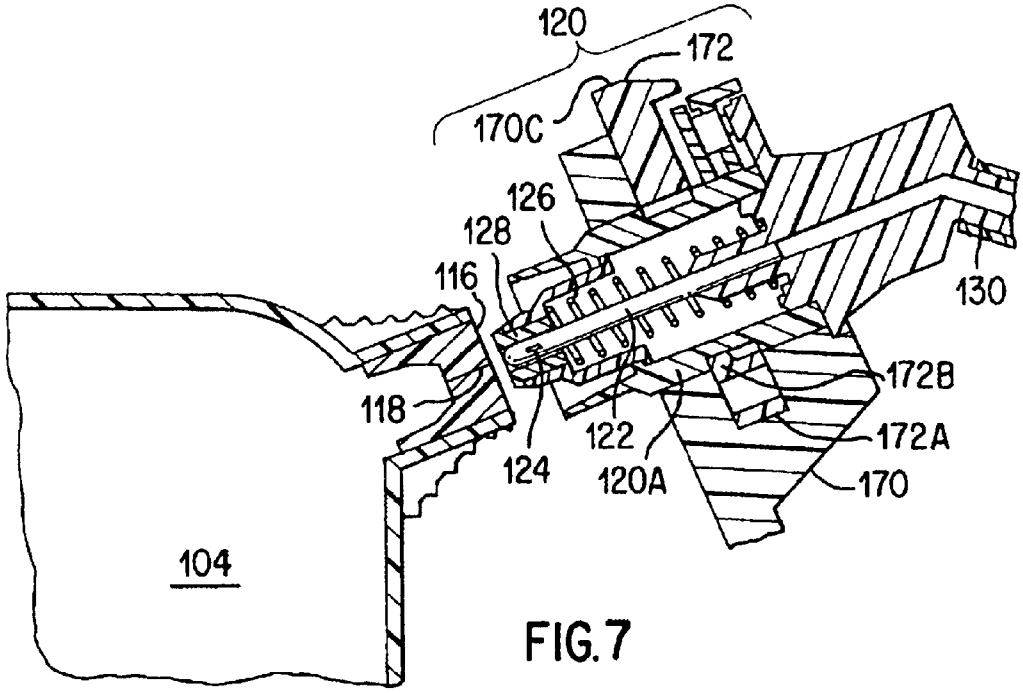
FIG. 7 is a cross-sectional view taken along line 7—7 of FIG. 6, showing the valve structure in a disengaged position relative to a refill port on the print cartridge.
Figure 8:
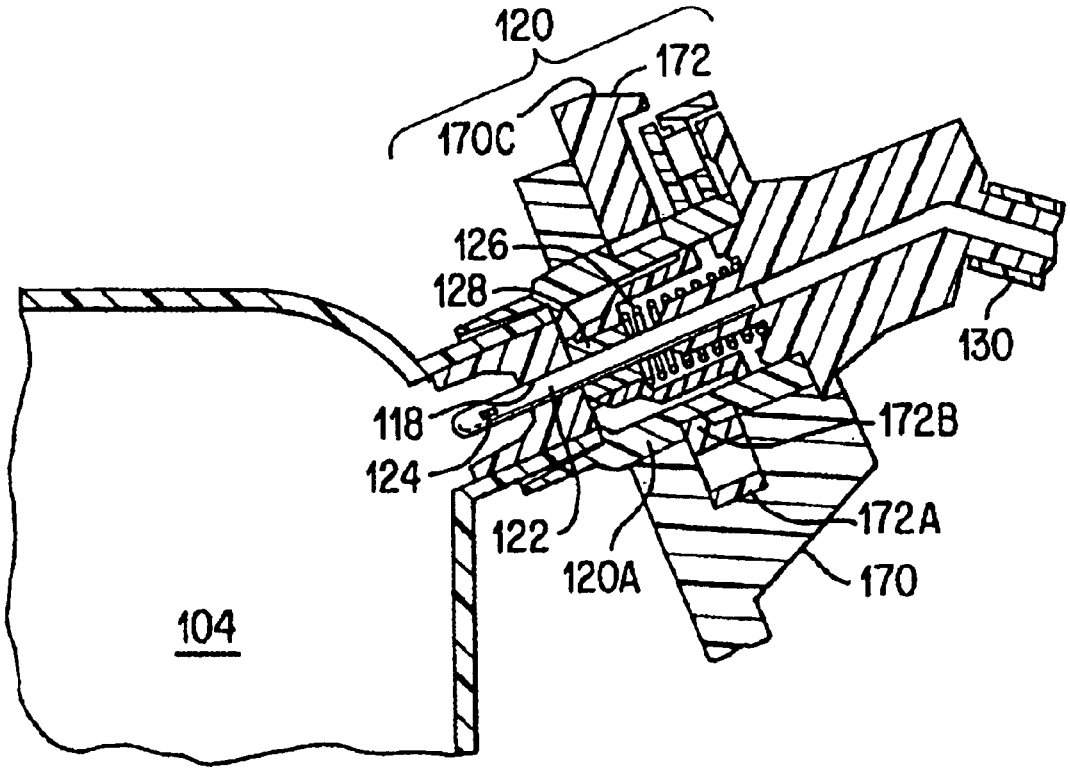
FIG. 8 is a cross-sectional view similar to FIG. 7, but showing the valve structure in an engaged position relative to the refill port of the print cartridge.
Figure 9:
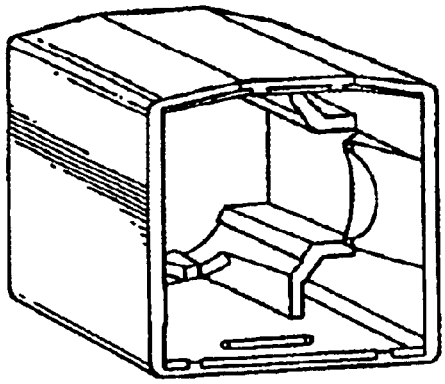
FIG. 9 is a bottom perspective view of a preferred embodiment of an alignment coupler.
Figure 10:
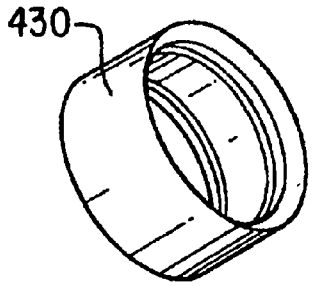
FIG. 10 shows a metal sleeve used on the ink supply valve.
Figure 11:
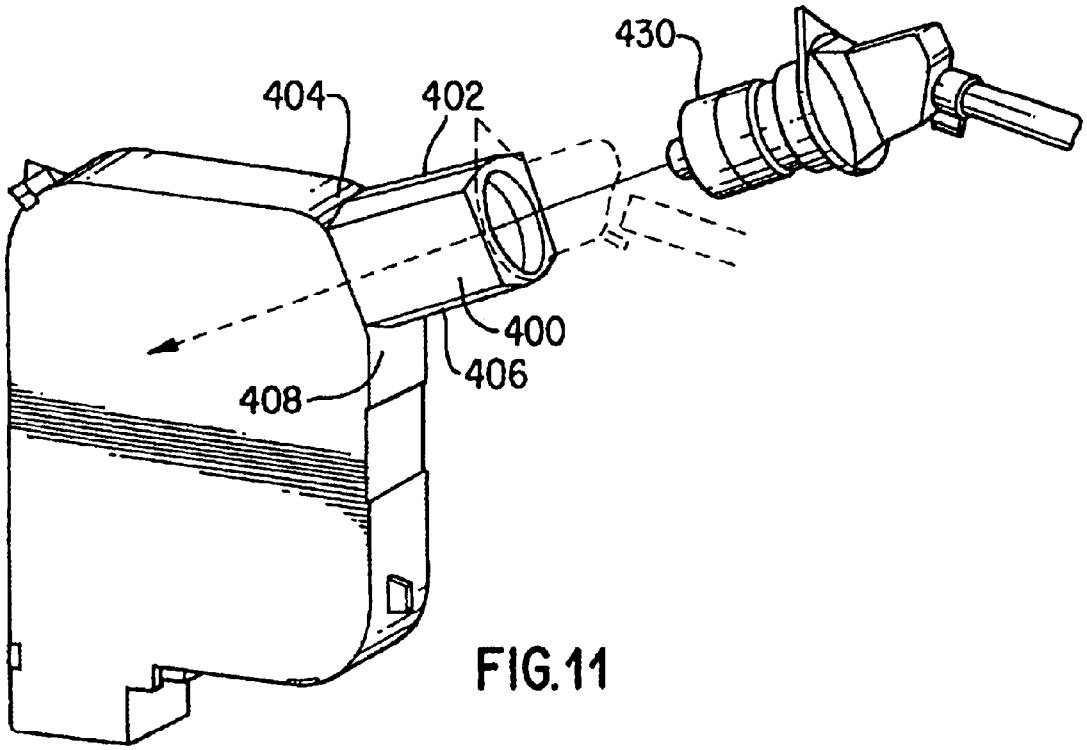
FIG. 11 shows the coupler mounted on a printhead frame, with an ink supply valve ready to be manually inserted to the position shown in phantom lines.
Figure 12:
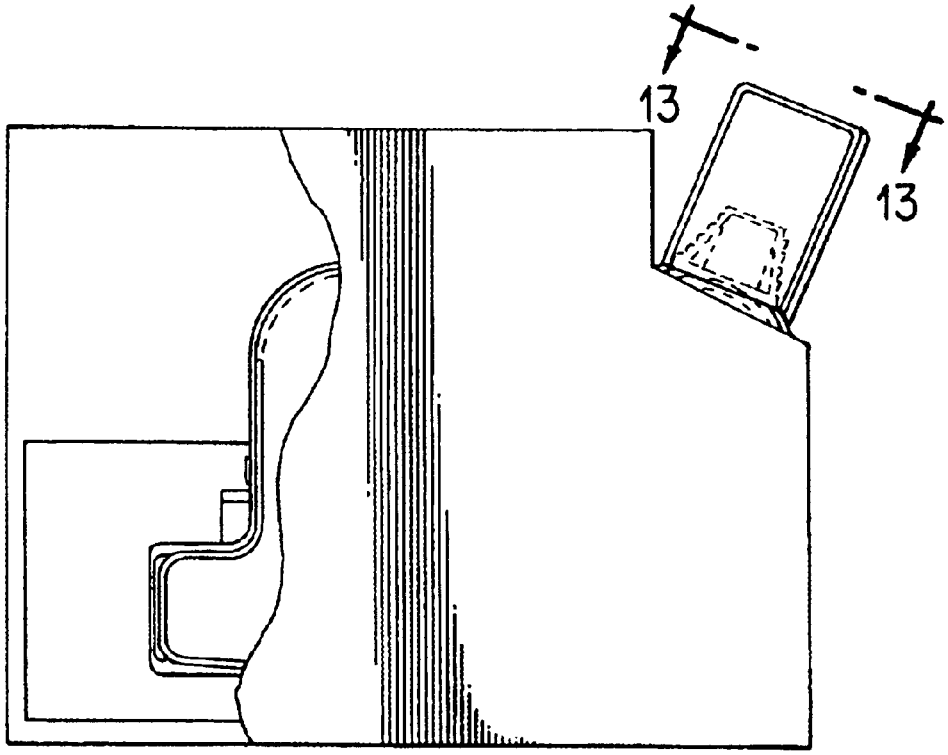
FIG. 12 is a side view of a printhead packaged in its shipping sleeve with the coupler already mounted on the printhead frame.
Figure 13:
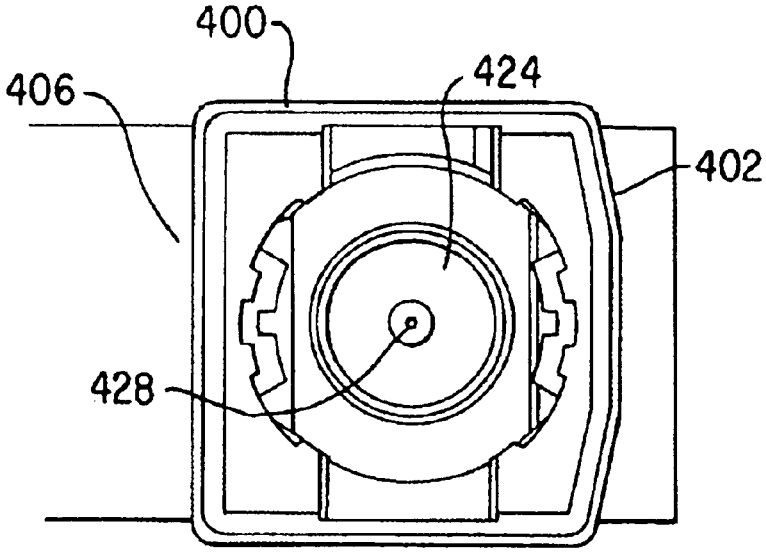
FIG. 13 is a top view taken along the line 13—13 in FIG. 12.
Figure 14:
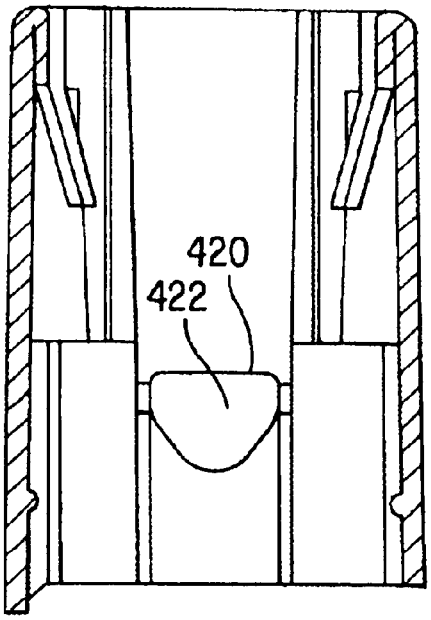
FIG. 14 is a sectional side view of the coupler.
Figure 15:
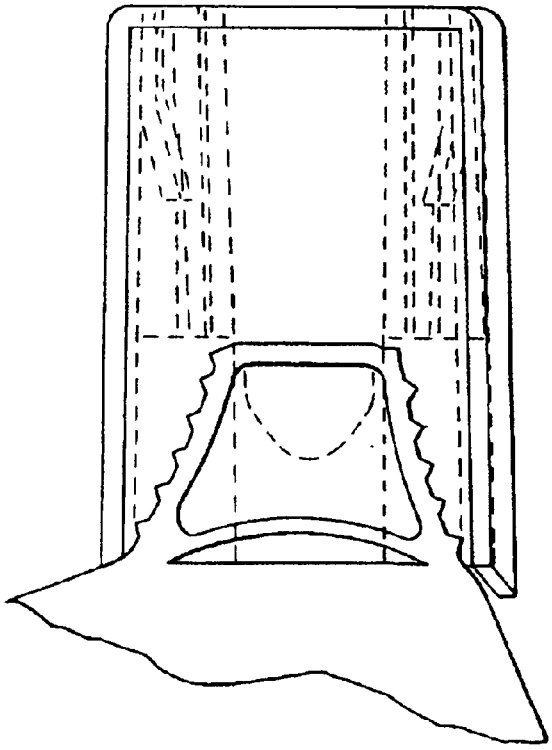
FIG. 15 is a side view of a transparent coupler installed on the printhead frame, showing the gripping handle of the printhead which incorporates the inlet port.
Figure 16:
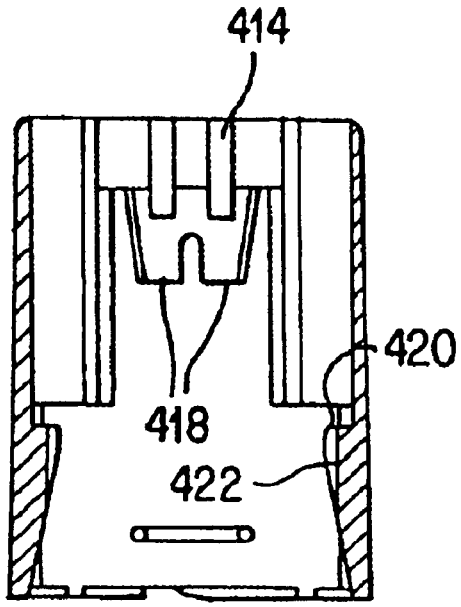
FIG. 16 is a sectional end view of the coupler.
Figure 17:
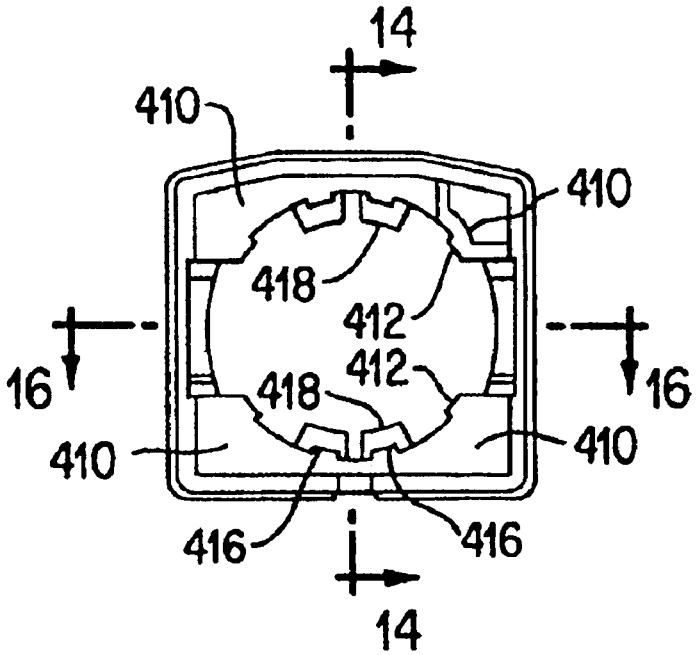
FIG. 17 is a top view of the coupler.
Figure 18:
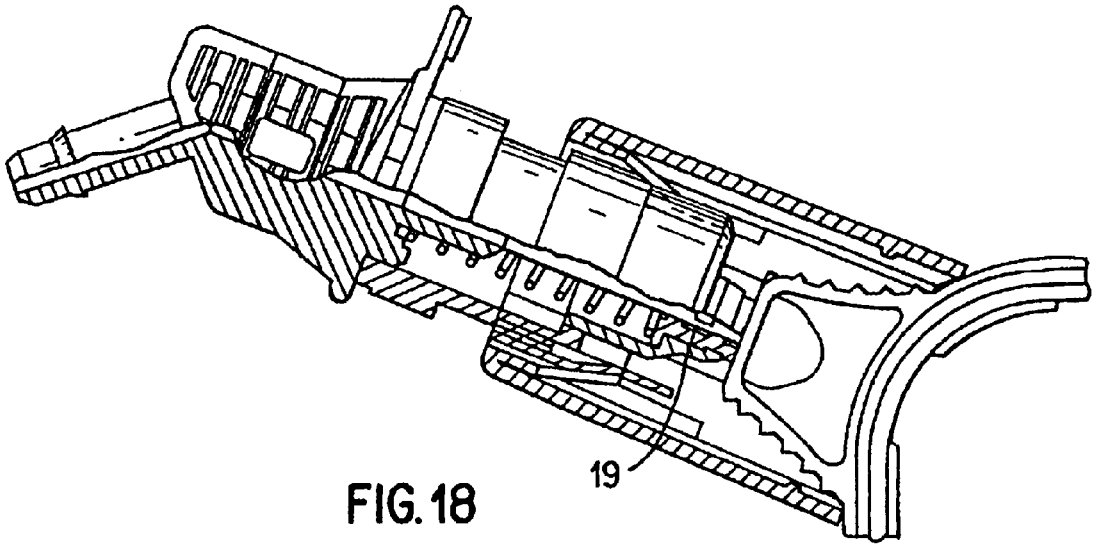
FIG. 18 is a sectional view of the coupler mounted on the printhead frame, showing the ink valve partially inserted into the coupler.
Figure 19:
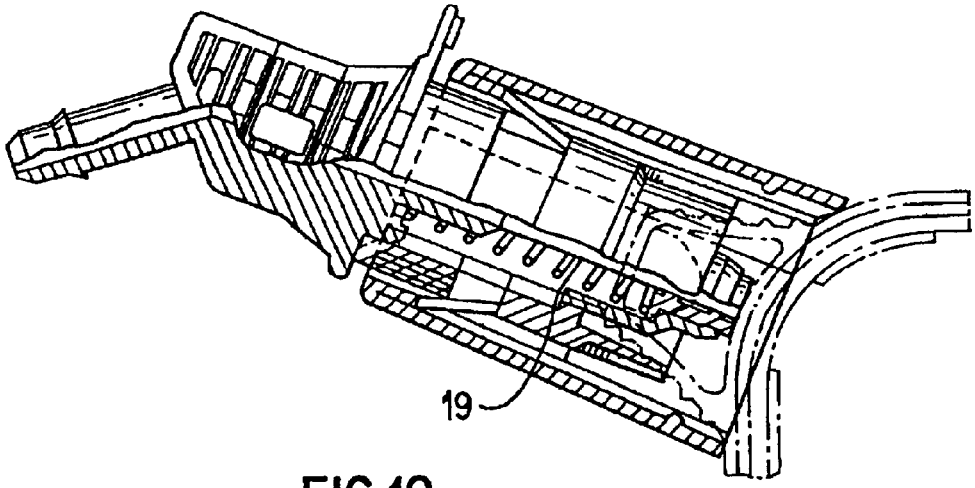
FIG. 19 is a sectional view like FIG. 18 showing the ink supply valve completely inserted into the coupler.
Figure 20:
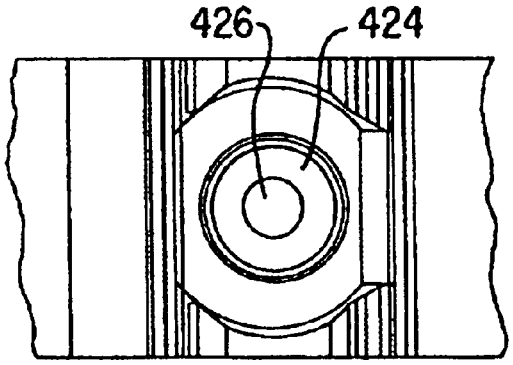
FIG. 20 is a top view of the gripping handle of the printhead showing the septum of the inlet port in closed position.
Figure 21:
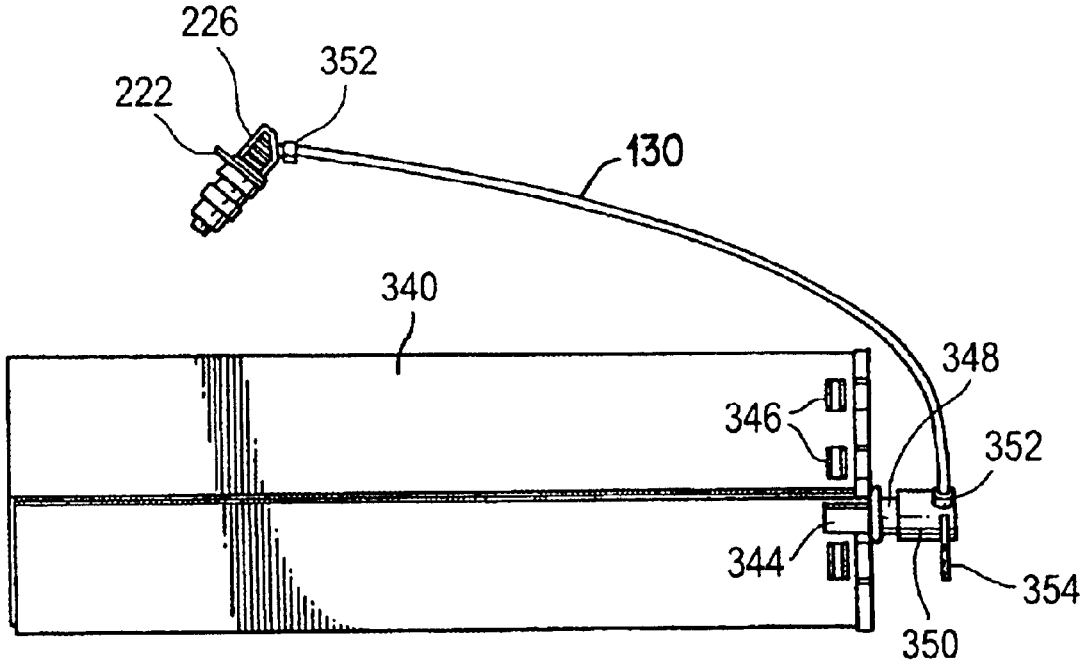
FIG. 21 is a bottom view of a presently preferred off-carriage ink supply module.

The 975' application describes a negative pressure, spring-bag print cartridge which is adapted for continuous refilling. FIGS. 6–8 show an ink-jet print cartridge 100, similar to the cartridges described in the '975 application, but which is adapted for intermittent refilling by addition of a self-sealing refill port in the grip handle of the cartridge. The cartridge 100 illustrates the cartridges 16 of the system of FIG. 1. The cartridge 100 includes a housing 102 which encloses an internal reservoir 104 for storing ink. A printhead 106 with ink-jet nozzles is mounted to the housing. The printhead receives ink from the reservoir 104 and ejects ink droplets while the cartridge scans back and forth along a print carriage during a printing operation. A protruding grip 108 extends from the housing enabling convenient installation and removal from a print carriage within an ink-jet printer. The grip is formed on an external surface of the housing.

FIGS. 6–8 show additional detail of the grip 108. The grip includes two connectors 110, 112 on opposing sides of a cylindrical port 114 which communicates with the reservoir 104. The port is sealed by a septum 116 formed of an elastomeric material. The septum 116 has a small opening 118 formed therein. The grip with its port 114 is designed to intermittently engage with a needle valve structure 120 connected via a tube 122 to an off-carriage ink reservoir such as one of the reservoirs 80–86 of the system of FIG. 1. FIG. 7 shows the valve structure 120 adjacent but not engaged with the port 116. FIG. 8 shows the valve structure 120 fully engaged with the port. As shown in FIG. 8, the structure 120 includes hollow needle 122 with a closed distal end, but with a plurality of openings 124 formed therein adjacent the end. A sliding valve collar 128 tightly fits about the needle, and is biased by a spring 126 to a valve closed position in FIG. 7. When the structure 120 is forced against the port 116, the collar is pressed up the length of the needle, allowing the needle tip to slide into the port opening 118, as shown in FIG. 8. In this position, ink can flow through the needle openings 124 between the reservoir 104 and the tube 130. Thus, with the cartridge 100 connected to an off-carriage reservoir via a valve structure such as 120, a fluid path is established between the print cartridge and the off-carriage reservoir. Ink can flow between the off-carriage ink reservoir to the cartridge reservoir 104. When the structure 120 is pulled away from the handle 108, the valve structure 120 automatically closes as a result of the spring 126 acting on the collar 128. The opening 118 will close as well due to the elasticity of the material 116, thereby providing a self-sealing refill port for the print cartridge.

FIGS. 6–8 illustrate a locking structure 172 for releasably locking the valve 120 into the refill arm 170 at socket 174. The structure 172 has locking surfaces 172B (FIG. 7) which engage against the outer housing of the valve body 120A. The structure is biased into the lock position by integral spring member 172A (FIGS. 7 and 8). By exerting force on structure 170 at point 170C (FIGS. 7 and 8) the spring is compressed, moving surface 172B out of engagement with the valve body, and permitting the valve to be pulled out of the refill arm socket. This releasing lock structure enables the valve and reservoir to be replaced quickly as a unit.

An ink printing system is described herein which includes an inkjet printer, a removable print cartridge having an ink reservoir, an initial fill port, and a refill valve, and an ink refill system for engaging the print cartridge's refill valve and transferring ink to the ink reservoir.

The print cartridge includes a handle which is used to facilitate insertion of the cartridge into, and removal of the cartridge from, a scanning carriage in the printer. The refill valve in the print cartridge is contained with the handle of the print cartridge. This location of the refill valve provides performance and manufacturing advantages.

The details of the alignment coupler of the preferred embodiment are clearly shown in FIGS. 9–20 as well as the related parts of the inlet port of the printhead reservoir and the outlet valve of the ink supply. The individual parts will be identified, and then their operation explained.

The coupler 401 includes an outer shell 400, a curved end wall 402 for engaging a matching curved frame 404 on the printhead, a straight end wall 406 for engaging a matching straight frame 408 on the printhead, elongated corner guides 410 each having a raised level land 412, side alignment guides 414 each having twin raised lands 416 which terminate into dual fingers 418 slanted inwardly from opposite end walls 402, 406 for engaging a small diameter slot 419 on the inlet valve, and locking ledges 420 with concave recesses 422 on opposite side walls 423 for engaging cutouts and cylindrical walls respectively on the printhead handle 425. The fingers 418 act like an arm which moves back and forth to receive and then lock in the slot 419, the inlet valve, while the entire side walls 423 expand to allow the locking ledges 420 to receive and then lock in the handle 425 of the printhead.

The printhead handle 425 includes a septum 424 having a central dimple 426 for helping the needle valve 122 of the ink supply to pass through normally closed path 428 of the septum, as more fully described in connection with FIGS. 6–8. A metallic sleeve 430 provides the additional diameter needed on the ink supply valve to provide proper alignment of the valve interconnections.

Consistent with the goals of the invention in the preferred embodiment of FIGS. 9–20, the printhead and ink supply are permanently connected through the coupler 401 by the end user prior to operating the printer. Back pressure for proper operation is provided by locating the spring bag printhead reservoir adjacent to and in communication with the nozzle plate of the printhead.

It was a major design objective to leverage and take advantage of as much existing hardware as possible such as from the intermittent refilling embodiment of FIGS. 6–8. This objective was met by utilizing a printhead body with the rubber septum refill port and an off-carriage ink reservoir with valve.

Other important goals that have been achieved in the preferred embodiment of FIGS. 9–20 include the development of a simple connection scheme that an end user can use intuitively without any training. Also, allowing the ink supply valve to rotate freely with respect to the printhead body after the aforementioned connection has been made by the coupler. Further, maintaining a radial alignment of 0.95 mm between the tip of the needle on the ink supply valve and the center of the dimple on the septum of the inlet port for the printhead body. This is required to ensure that an air-tight fluid connection is made. Exceeding this alignment tolerance results in a defective fluid interconnection with a rubber of the septum stretching over the tip of the needle like a finger cot on a finger. This alignment is facilitated by the structural features of the alignment coupler during the entire time period while the user is holding the valve and inserting it into the printhead body.

Prolonged insertion of the needle into the septum causes the septum to take a "compression set". If the needle is removed, the pen will ingest air, lose backpressure and begin leaking ink. This required that the valve interconnection be as tamper-proof and permanent as possible.

The alignment coupler 401 snap fits over existing features on the handle area of the printhead body. It contains a circular opening shown schematically in FIG. 11, with cylindrical features such as guides 410, 414 to provide alignment of the valve needle to the septum 116. It also has cantilevered fingers 418 that "snap" into an existing groove such as slot 419 on the ink supply valve 120. This provides permanent latched retention of the ink supply valve in the inlet port 114 of the printhead with the ink supply valve and matching inlet valve 120 held in open position whether or not the printer is in active, dormant or overnight storage mode. The metal sleeve 430 fits over the end of the ink supply valve 120 and increases the diameter of the front part of the valve. A diameter of 14.6 mm was required to ensure that the alignment goal of plus or minus 0.95 mm was met. This could also have been achieved by changing the valve design to have one larger diameter. This would have made the new valve design incompatible with the existing manufacturing equipment. To maintain compatibility, a separate part is added to the ink supply valve 120.

Thus it will be appreciated by those skilled in the art that the invention does achieve the objectives of providing a high reliability fluid connection that is made by the end user and takes advantage of related ink component features and manufacturing processes. However, such features did require modification since the printhead frame of the preferred embodiment does not by itself provide any features suitable for aligning the ink supply valve to the rubber septum in the inlet port within the required plus or minus 0.95 mm tolerance. To overcome this deficiency, the unique alignment coupler was developed, and is preferably installed on the printhead frame before the customer receives the unit, such as in the factory.

The alignment coupler could have easily been installed on the pen frame on the main manufacturing line. Unfortunately, the packaging equipment that places the printhead into its shipping sleeve could not handle a printhead with an alignment coupler already installed. In order to address this issue we created a printhead shipping sleeve that has a corner notch which allows access to the handle region of the printhead. The alignment coupler is attached while the printhead is in its shipping sleeve. The exposed coupler is protected by a kit box that holds both the printhead and the modular ink reservoir.

Figure 22:
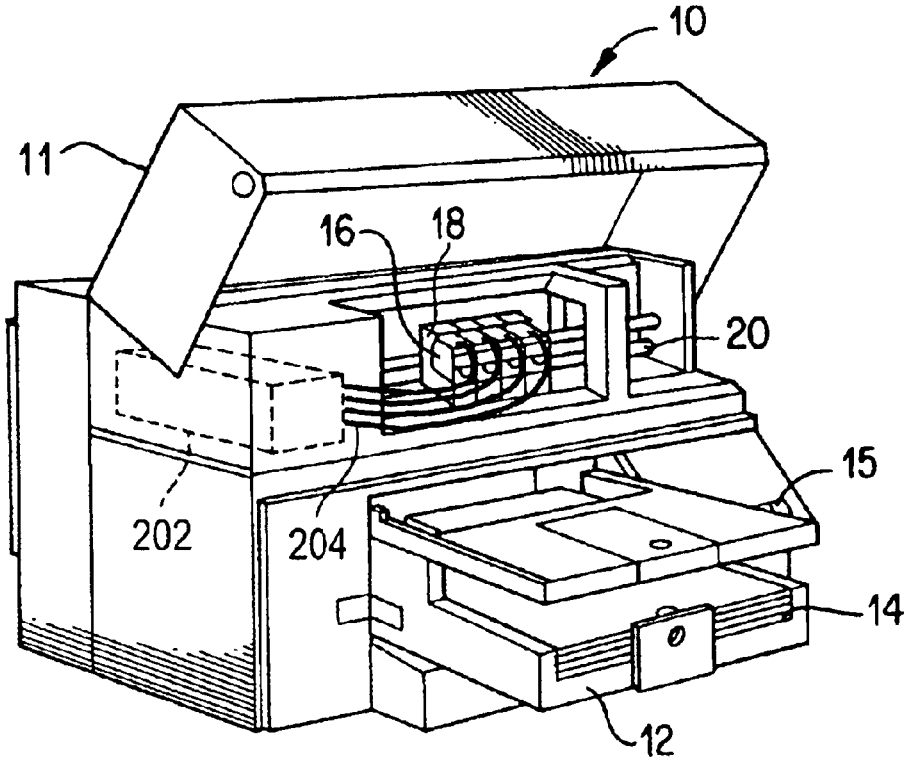
FIG. 22 is a perspective view of an alternate embodiment inkjet printer where hoses are connected between the valves of the print cartridges and a separate ink supply to refill the print cartridges.
Figure 23:
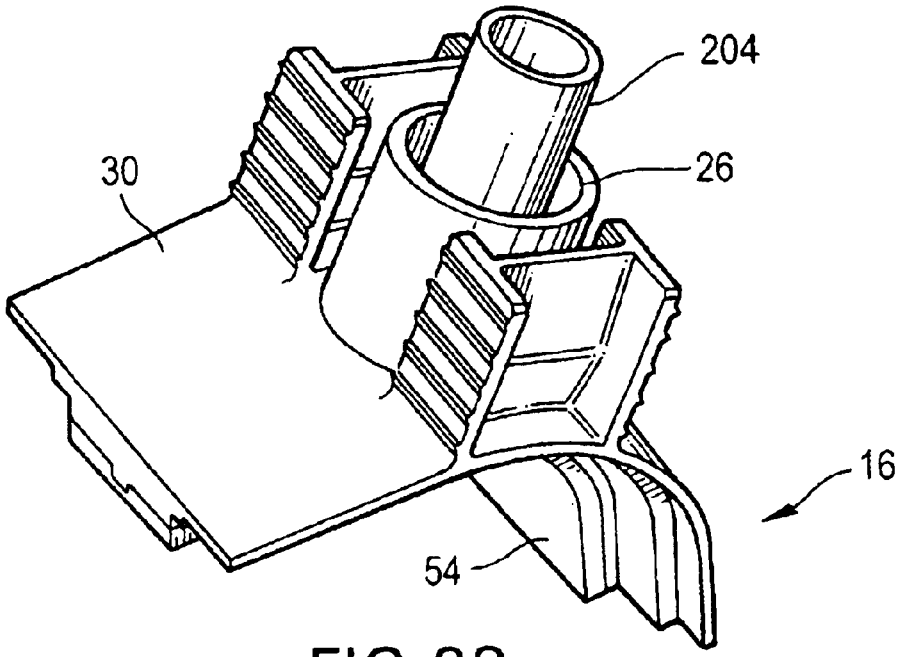
FIG. 23 is a close-up view of the valve portion of the print cartridge having a hose extending therefrom.

FIGS. 22 and 23 illustrate an alternative embodiment which provides either a continuous refill of ink bag 51 within print cartridge 16 or intermittent filling of each print cartridge 16 during various times that printer 10 is activated.

Printer 10 in FIG. 22 may be identical to that shown in FIG. 1 but further houses a replaceable ink reservoir 202, shown in dashed outline, containing black, cyan, magenta, and yellow ink for the four print cartridges 16 supported in scanning carriage 18.

Hoses 204 contains valves and are engageable and disengageable from valve 24 in print cartridge 16.

FIG. 23 illustrates one hose 204 extending from cylindrical sleeve 26 on print cartridge 16.

As ink is being depleted from the ink bag 51 within each print cartridge 16 while printing, ink is drawn through flexible hoses 204 into their respective print cartridges 16. Alternatively, refilling may occur at predetermined times, such as at the end of a printing cycle or at other times.

In another embodiment valve 24 is removed from print cartridge 16 and the end of hose 204 is provided with a simple male type tip which is inserted through the now empty hole through outer frame 30 and inner frame 54 to create a fluid seal. In another embodiment, the end of hose 204 is simply pushed over the end of valve 24.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A method of liquid replenishment to a printhead mounted on a carriage of a printer, comprising:

providing a print cartridge having a printhead, a handle and a liquid reservoir, with said printhead on the print cartridge and in communication with the liquid reservoir, and with an inlet port valve incorporated as part of the handle;

initially filing the print cartridge reservoir with liquid through an inlet hole separate from said inlet port valve;

providing a liquid supply with an outlet valve, said liquid supply mountable off the carriage;

installing the print cartridge on the carriage with the inlet port valve accessible without having to remove the print cartridge from the carriage;

coupling the inlet port valve to the outlet valve to allow continuous fluid communication from the liquid supply to the printhead;

subsequently refilling the print cartridge reservoir from said liquid supply through said inlet port valve; and after said coupling, preventing any disconnection of the fluid communication during active operation of the printer when the liquid supply is being ejected from the printhead as well as during dormant periods before and after said active operation.

2. The method of claim 1 wherein said inlet port valve in a normally closed position prior to said coupling of the inlet port valve to the outlet valve.

3. The method of claim 1 which includes coupling the inlet port valve to the outlet valve through a separate coupler.

4. The method of claim 3 wherein the separate coupler is a unitary member to facilitate said coupling.

5. The method of claim 4 wherein the separate coupler includes first locking means for attachment to an inlet port of the print cartridge to facilitate said coupling.

6. The method of claim 5 wherein the separate coupler includes second locking means for attachment to the outlet valve to facilitate said coupling.

7. The method of claim 3 wherein the separate coupler includes locking means for securely holding said inlet port valve in fluid communication with said outlet valve to facilitate said coupling.

8. The method of claim 3 wherein the separate coupler is manually attachable to said inlet port valve and said outlet valve to facilitate said coupling.

9. The method of claim 1 wherein said step of preventing any disconnection of the fluid communication permits rotation of the outlet valve relative to the print cartridge.

10. The method of claim 1, further comprising:

moving the carriage with the print cartridge installed in the carriage along a swath axis during said active operation of the printer, with the liquid supply mounted in the printer at a location off the carriage.

11. A liquid replenishment system for one or more inkjet printheads removably mounted on a carriage of a printer, comprising:

a print cartridge having a printhead;

a handle on the print cartridge, said handle having an inlet port with a control valve therein, said control valve in a normally closed position to prevent the liquid supply from passing through the inlet port;

a sealed liquid supply having an outlet valve; and a coupler having one end attachable to said handle and another end attachable to said outlet valve, said coupler including locking means for securely holding said inlet port in fluid communication with said outlet valve upon completion of an attachment of the coupler to both said handle and said outlet valve without allowing any disconnection during normal operation of the printer while the carriage is passing over a print zone during a printing operation, said locking means including first locking means for attachment to said inlet port; and wherein said control valve remains in the normally closed position when said coupler is attached to said inlet port without also being attached to said outlet valve.

12. The system of claim 11 which further includes the print cartridge having a liquid reservoir, said printhead and said handle incorporated as part of said print cartridge with said inlet port in communication with said liquid reservoir.

13. The system of claim 12 including liquid ink in said liquid reservoir.

14. The system of claim 11 wherein said outlet valve is in a normally closed position to prevent the liquid supply from passing through the outlet valve.

15. The system of claim 11 wherein said locking means includes second locking means for attachment to said outlet valve.

16. The system of claim 11 wherein the print cartridge includes a body, and said locking means permits rotation of said outlet valve relative to said print cartridge body.

* * * * *